US011124374B2

(12) United States Patent
Ogasawara

(10) Patent No.: US 11,124,374 B2
(45) Date of Patent: Sep. 21, 2021

(54) SHEET CONVEYING APPARATUS, IMAGE READING APPARATUS THEREWITH AND IMAGE FORMING APPARATUS THEREWITH

(71) Applicant: CANON KABUSHIKI KAISHA, Tokyo (JP)

(72) Inventor: Akio Ogasawara, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 16/394,158

(22) Filed: Apr. 25, 2019

(65) Prior Publication Data

US 2019/0337743 A1 Nov. 7, 2019

(30) Foreign Application Priority Data

May 2, 2018 (JP) ..... JP2018-088545

(51) Int. Cl.

| | |
|---|---|
| ***B65H 1/04*** | (2006.01) |
| ***B65H 1/08*** | (2006.01) |
| ***B65H 7/02*** | (2006.01) |
| ***B65H 3/06*** | (2006.01) |
| ***B65H 1/26*** | (2006.01) |

(52) U.S. Cl.

CPC ..... *B65H 1/04* (2013.01); *B65H 1/08* (2013.01); *B65H 1/26* (2013.01); *B65H 3/0684* (2013.01);

(Continued)

(58) Field of Classification Search

CPC .. B65H 2405/1142; B65H 2405/11425; B65H 2405/1144; B65H 2511/12;

(Continued)

(56) References Cited

U.S. PATENT DOCUMENTS 5,975,517 A 11/1999 Lim
6,070,048 A 5/2000 Nonaka et al.
(Continued)

FOREIGN PATENT DOCUMENTS

CN 1204582 A 1/1999
JP H08-012114 A 1/1996
(Continued)

OTHER PUBLICATIONS

Dec. 8, 2020 Chinese Official Action in Chinese Patent Appln. No. 201910358012.4.

*Primary Examiner* — Jeremy R Severson
(74) *Attorney, Agent, or Firm* — Venable LLP

(57) ABSTRACT

Disclosed is a sheet conveying apparatus, including: a first guide member for restricting a movement of an end portion of a sheet in a sheet width direction; a second guide member for restricting a movement of the other end portion of the sheet in the sheet width direction; and a moving portion, wherein when one guide member of the first guide member and the second guide member is moved in the sheet width direction, the moving portion moves the other guide member in a direction opposite to a direction in which the one guide member is moved while being interlocked with a movement of the one guide member in a first area of a moving area, and allows the one guide member to be moved without being interlocked with a movement of the other guide member in a second area of the moving area.

12 Claims, 13 Drawing Sheets

(52) U.S. Cl.
CPC ..... *B65H 7/02* (2013.01); *B65H 2402/64* (2013.01); *B65H 2403/411* (2013.01); *B65H 2511/12* (2013.01); *B65H 2801/06* (2013.01); *B65H 2801/39* (2013.01)

(58) Field of Classification Search
CPC .... B65H 31/20; B65H 2403/411; B65H 1/08; B65H 7/02; B65H 3/0684; B65H 1/26
USPC ..... 271/171
See application file for complete search history.

(56) References Cited

U.S. PATENT DOCUMENTS

| | | | | |
|---|---|---|---|---|
| 6,536,968 | B2 | 3/2003 | Lee et al. | |
| 7,600,749 | B2 | 10/2009 | Lee et al. | |
| 7,641,184 | B2 * | 1/2010 | Terashima | B65H 3/5261 271/10.13 |
| 8,398,074 | B2 * | 3/2013 | Uchino | B65H 1/00 271/171 |
| 9,266,691 | B2 | 2/2016 | Morimoto | |
| 9,493,317 | B2 | 11/2016 | Morimoto | |
| 2014/0374984 | A1 | 12/2014 | Morimoto | |
| 2016/0130099 | A1 | 5/2016 | Morimoto | |
| 2017/0029229 | A1 | 2/2017 | Morimoto | |

FOREIGN PATENT DOCUMENTS

| | | | | |
|---|---|---|---|---|
| JP | 2003-104566 | A | | 4/2003 |
| JP | 2004352463 | A | * | 12/2004 |
| JP | 2015-027913 | A | | 2/2015 |

* cited by examiner

SHEET CONVEYING APPARATUS, IMAGE READING APPARATUS THEREWITH AND IMAGE FORMING APPARATUS THEREWITH

BACKGROUND OF THE INVENTION

Field of the Invention

The present invention relates to a sheet conveying apparatus capable of conveying a small size sheet, and to an image forming apparatus and the like including the sheet conveying apparatus.

The reading apparatus which sequentially conveys and reads sheets (documents) placed on a placing tray suppresses skew feeding of a conveyed sheet by the leading end of the sheet abutting against a shutter member to position the leading end of the sheet in the sheet conveying direction and by side guides abutting against both sides of the sheet in the width direction.

However, when the sheets placed on the tray are small size sheets such as business cards, the moving area of the side guide may not correspond to the small size sheets, or the sheets may not properly abut against the shutter member. Therefore, conventionally, for conveying small size sheets, the configurations shown in Japanese patent Application Laid-Open Publications No. 2003-104566 and No. 2015-27913 have been proposed.

Japanese Patent Application Laid-Open Publication No. 2003-104566 discloses a medium conveying apparatus in which a medium holder is mounted for holding a medium to be conveyed, wherein a small size sheet is easily set at a hopper with the medium holder.

Japanese Patent Application Laid-open Publication No. 2015-27913 discloses a configuration having a feeding portion for feeding a sheet placed on a sheet placing tray, a first restricting portion provided in the vicinity of a sheet feeding position for restricting the movement of a sheet having a first sheet width in the conveying direction, and a second restricting portion for restricting the movement of a sheet such as a business card having a second sheet width which is less than the first sheet width in the conveying direction.

However, in the configuration using a medium holder as described in Japanese Patent Application Laid-Open Publication No. 2003-104566, it is necessary for a user to set the medium holder on the hopper when setting a small size medium like a business card. When a user has lost the medium holder, the user cannot set a small size medium. Also, the provision of the medium holder increases the cost.

In addition, as in Japanese Patent Application Laid-Open Publication No. 2015-27913, in the configuration having a restricting portion for restricting not only the movement of a sheet of a normal width such as an A4 sheet but also the movement of a small size document such as a business card in the conveying direction, the mechanism is complicated and the cost increases due to the provision of a restricting portion which performs a restricting operation according to the size of a document.

SUMMARY OF THE INVENTION

A sheet conveying apparatus according to the present invention, comprises:

a placing portion on which a sheet is placed;

a conveying member configured to convey the sheet placed on the placing portion;

a first guide member configured to restrict a movement of an end portion of the sheet placed on the placing portion in a sheet width direction which is orthogonal to a conveying direction of the sheet;

a second guide member configured to restrict a movement of the other end portion of the sheet placed on the placing portion in the sheet width direction; and a moving portion, wherein when one guide member of the first guide member and the second guide member is moved in the sheet width direction, the moving portion moves the other guide member of the first guide member and the second guide member in a direction opposite to a direction in which the one guide member is moved while being interlocked with a movement of the one guide member in a first area of a moving area, and the moving portion allows the one guide member to be moved without being interlocked with a movement of the other guide member in a second area of the moving area.

Further features of the present invention will become apparent from the following description of exemplary embodiments with reference to the attached drawings.

DESCRIPTION OF THE EMBODIMENTS

Next, preferred embodiments of the present invention will be described in detail below with reference to the accompanying drawings.

First Embodiment

Figure 1:
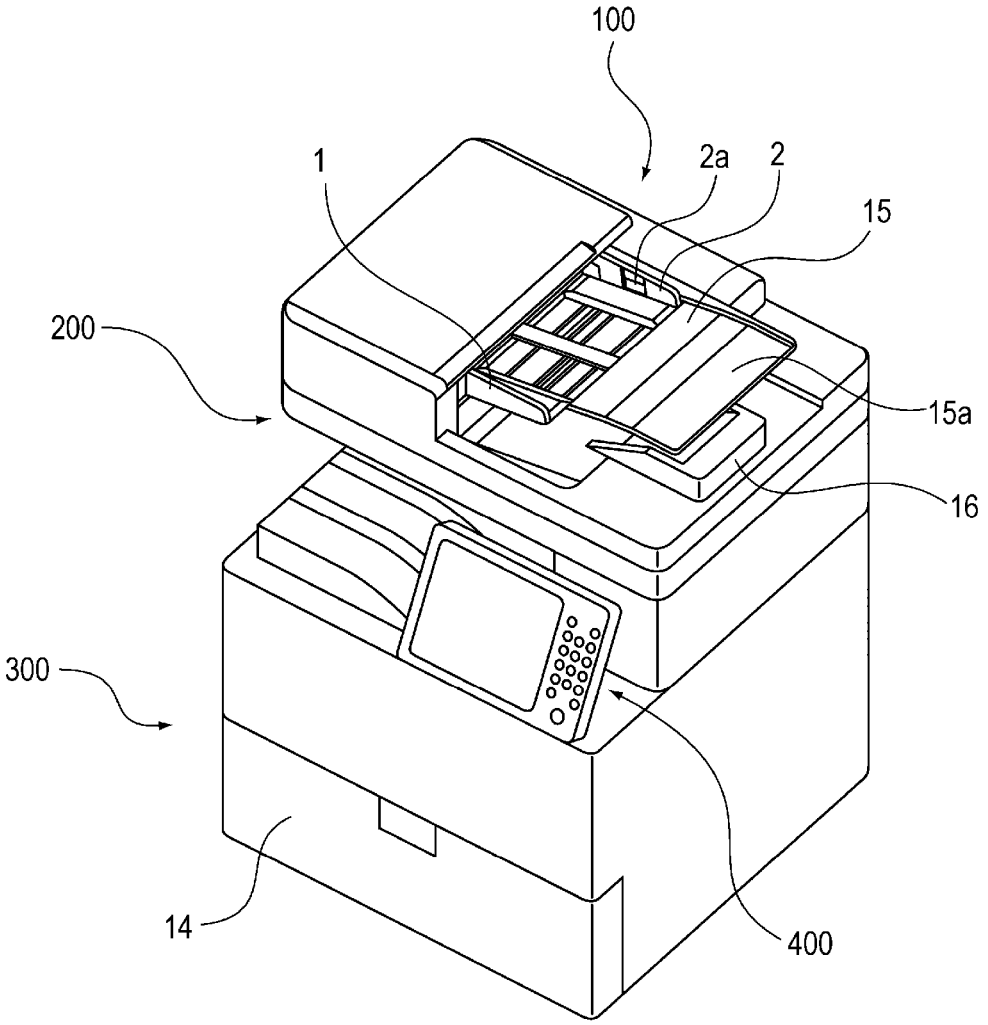
FIG. 1 is an explanatory perspective view of an image forming apparatus.
Figure 2:
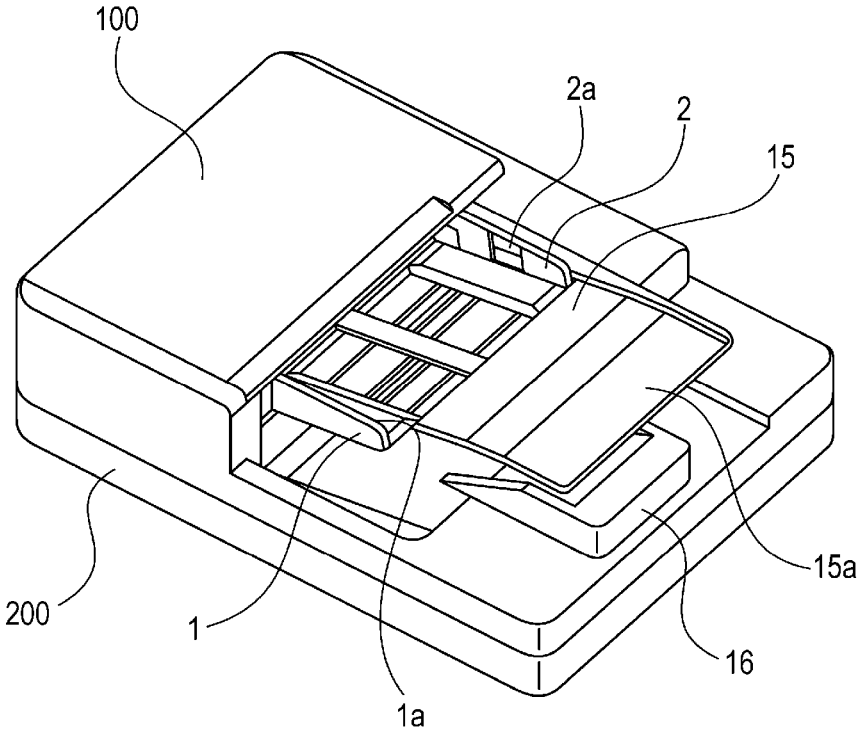
FIG. 2 is an explanatory perspective view of an image reading apparatus.
Figure 3:
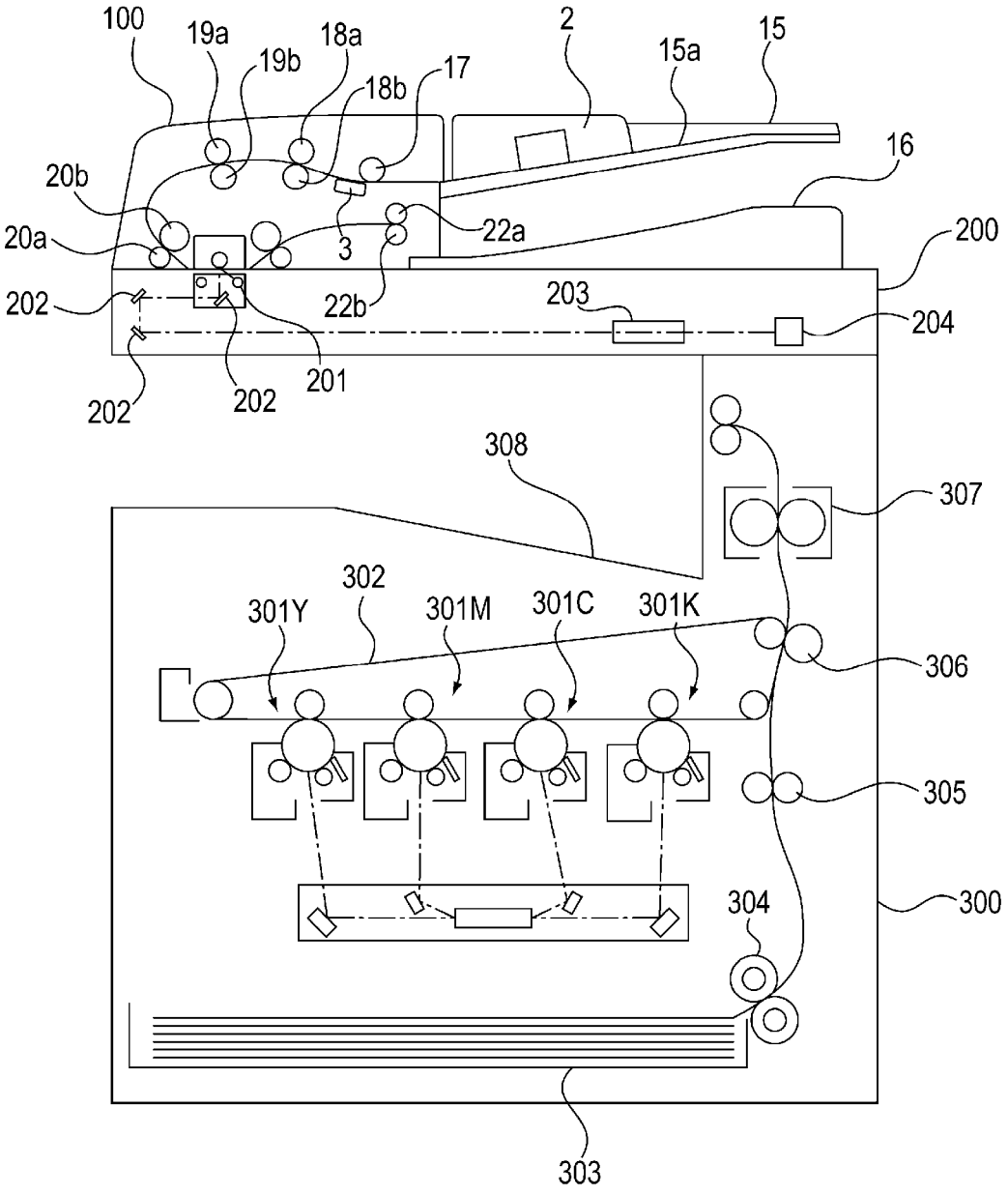
FIG. 3 is a schematic sectional view of an image forming apparatus including a sheet conveying apparatus.

FIG. 1 is a perspective view of an image forming apparatus. FIG. 2 is a perspective view of an image reading apparatus having a document conveying unit which is a sheet conveying apparatus. FIG. 3 is a schematic diagram showing an internal configuration of the image forming apparatus.

<Overall Configuration of Image Forming Apparatus>

The image forming apparatus according to the present embodiment is a multi-function apparatus and includes the document conveying portion 100, the image reading portion 200 that reads a document conveyed from the document conveying portion 100, the image forming portion 300 that forms an image based on information read by the image reading portion 200 or information input from outside, and the operational panel 400 provided above the image forming portion 300.

With reference to FIGS. 1 to 3, the overall configuration of the image forming apparatus will be described in conjunction with the operations. At first, a document is placed by a user on the placing surface 15*a* of the document placing tray 15 of the document conveying portion 100, which is a sheet conveying apparatus. Next, the first guide member 1 and the second guide member 2 arranged symmetrically with respect to the center of the feeding roller 17 in the sheet width direction (direction orthogonal to the sheet conveying direction) are pushed by a user to abut against the end portions of the document in the sheet width direction. Further, the document is placed on the document placing tray 15 to abut against the shutter 3 that restricts the movement of the document in the document conveying direction.

When the operation for starting the reading of the documents is performed on the operational panel 400, the documents are conveyed to the separating portion by the feeding roller 17 shown in FIG. 3, which is a conveying member where the documents are separated one by one by the separating roller 18*a* and the returning roller 18*b*. Thereafter, each document is nipped and conveyed by the roller pairs 19*a*, 19*b*, 20*a*, 20*b*, and 21*a*, 21*b*.

Below the document conveying portion 100, the image reading portion 200 serving as the image reading apparatus is disposed, where the light emitted from the light source 201 is reflected by the mirror 202 and the reflected light is read by the reading element 204 via the lens 203. Thereafter, the documents are stacked on the document placing surface of the document discharge tray 16 by the discharge roller pair 22*a*, 22*b*.

The image forming portion 300 forms an image with an electro-photographic method. The image forming portion 300 has the four image forming units 301Y, 301M, 301C and 301K that form images of yellow Y, magenta M, cyan C and black K, respectively. Upon image formation, a toner image formed by each unit is primarily transferred onto the rotating intermediate transfer belt 302 to form a color image. In synchronism with this image formation, a recording sheet is conveyed from the sheet cassette 303 mounted at the bottom of the apparatus to the secondary transfer portion by the feeding roller 304 and the conveying roller 305. In the secondary transfer portion, the toner on the intermediate transfer belt 302 is transferred onto the recording sheet by applying a bias to the secondary transfer roller 306. Thereafter, the recording sheet is conveyed to the fixing portion 307, where the recording sheet is heated and pressurized to fix the toner on the recording sheet. Thereafter, the recording sheet is discharged to the inside discharge portion 308.

<Sliding Mechanism of Guide Member>

Next, with reference to FIGS. 4 to 6, the configuration for setting a document on the document placing tray 15 according to the present embodiment will be described with the configuration of a moving portion in which the first guide member 1 and the second guide member 2 are slid being mainly explained.

Figure 4:
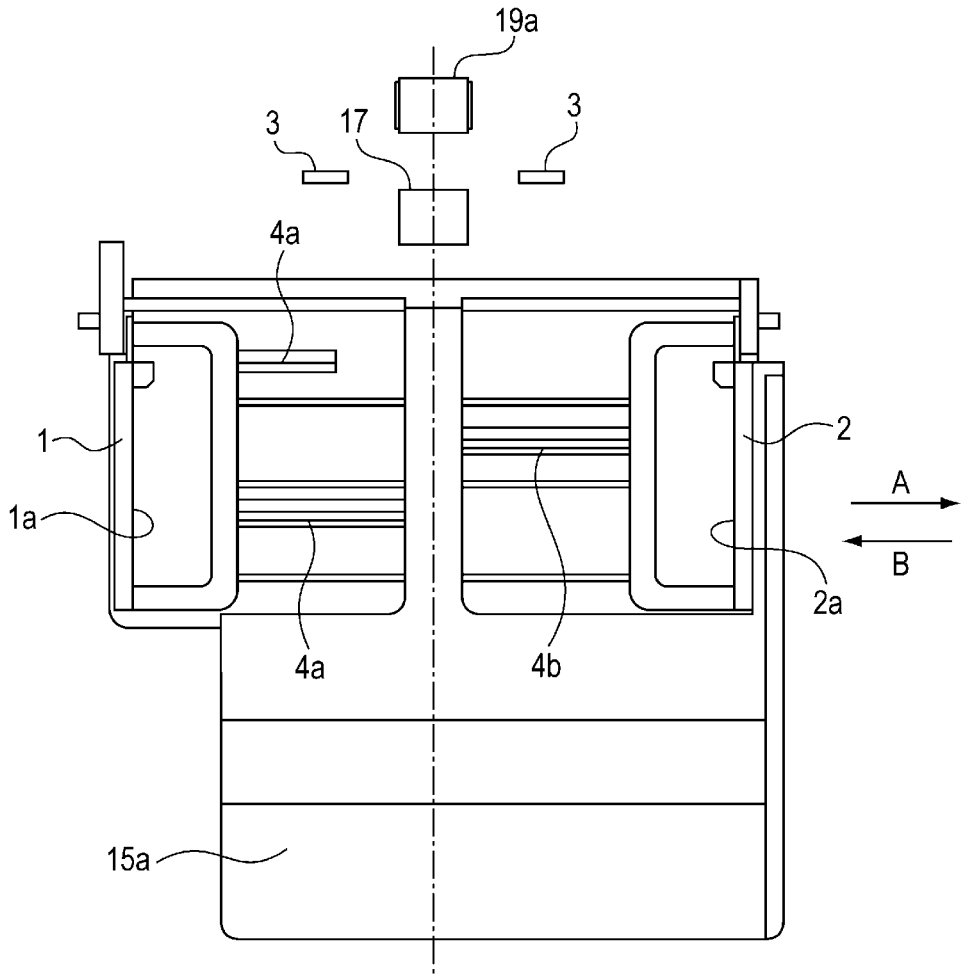
FIG. 4 is a plan view of a document placing tray.
Figure 5:
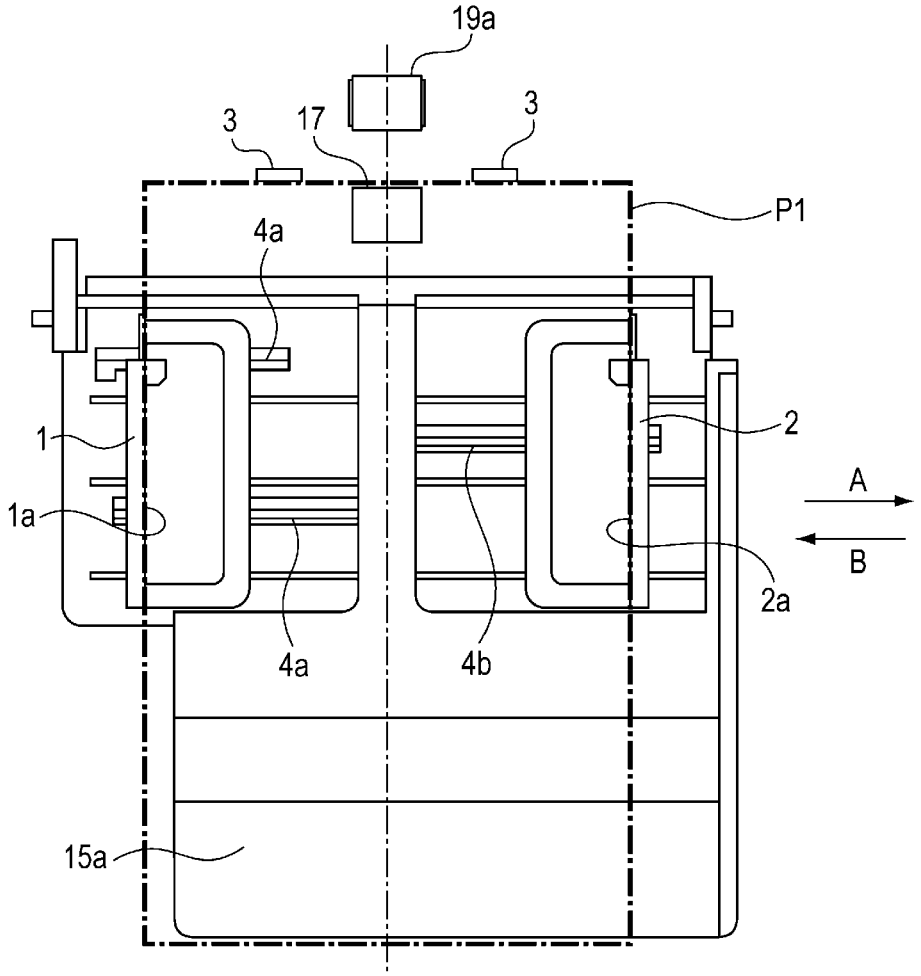
FIG. 5 is an explanatory plan view in a case where a normal size sheet is placed on the document placing tray.

FIGS. 4 and 5 show a case where a sheet with a normal width which is normally used as an A4 size or an A3 size sheet is set on the document placing tray 15 which serves as a placing portion. Further, FIG. 6 is a view showing the rear side 15*b* of the document placing surface of the document placing tray in this embodiment.

The purpose of setting a document on the document placing tray 15 is to correct the posture of the document with respect to the document conveying direction before it is conveyed so as to prevent skew feeding or the like of the document.

The user brings the leading end of the document P1 into contact with the shutters 3 of the document feeding portion when setting the document P1. When setting a document, the shutters 3 protrude and when conveying a document, the shutters 3 are retracted to enable the conveying of the document. The shutters 3 are disposed at positions where the shutters 3 are substantially symmetrical in the document width direction with respect to the center of the feeding roller 17. By bringing the leading end of the document into contact with the shutters 3, the leading end of the document is positioned and the feeding roller 17 can appropriately convey the document.

On the document placing tray 15, the first guide member 1 and the second guide member 2, which are slidable in the sheet width direction (arrow A direction and arrow B direction), which are directions orthogonal to the conveying direction of the document P1, are opposed to each other. The first guide member 1 restricts the movement of one end portion of the sheet placed on the document placing tray 15 in the width direction. The second guide member 2 restricts the movement of the other end portion of the sheet placed on the document placing tray 15 in the width direction.

Figure 6:
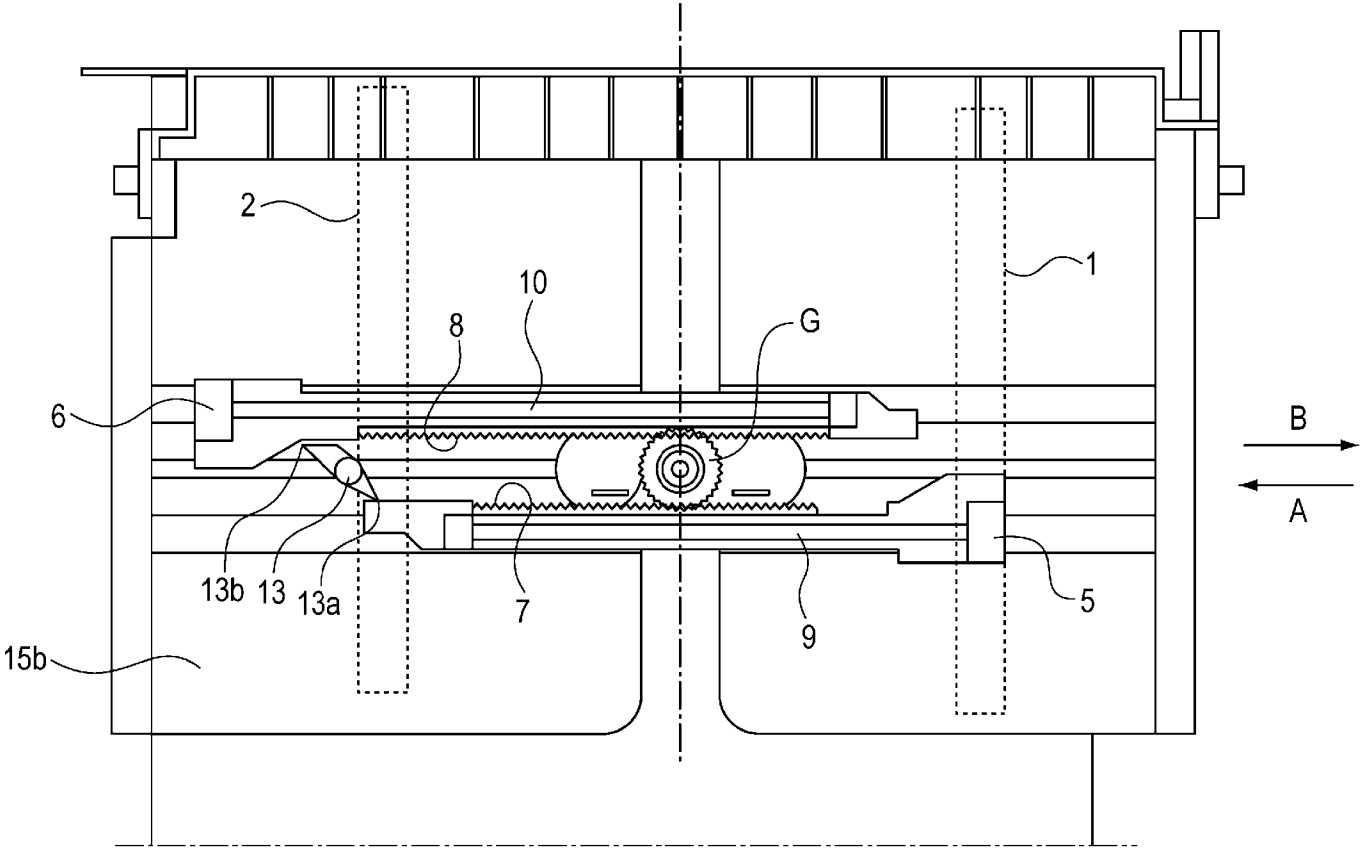
FIG. 6 is a rear view of the document placing tray.

As shown in FIGS. 4 and 6, the elongated hole portions 4*a*, 4*b* which are elongated in the sliding direction are provided in parallel on the document placing tray 15. The penetrating portion 5 formed at the first guide member 1 penetrates the elongated hole portion 4*a* to protrude from the rear side 15*b* of the document placing tray 15. The first slide 9 on which the first rack portion 7 is formed is integrally provided on the penetrating portion 5. Similarly, the penetrating portion 6 formed at the lower end of the second guide member 2 penetrates the elongated hole portion 4*b* to protrude from the rear side 15*b* of the document placing tray 15 and the second slide 10 on which the second rack portion 8 is formed is integrally provided on the penetrating portion 6.

The pinion gear G is provided at a position where the pinion gear G is nipped by the slides 9 and 10 on the rear surface of the document placing tray 15 such that the pinion gear G meshes with the rack portions 7 and 8 on the pitch line of the teeth provided on the rack portions 7 and 8. In a region (first region) in which the rack portions 7 and 8 are meshed with the pinion gear G, the first guide member 1 and the second guide member 2 move while they are interlocked with each other.

As a result, when the first guide member 1 is moved in the sheet width direction, the second guide member 2 moves interlocking with the movement of the first guide member 1 in the direction opposite to the direction in which the first guide member 1 moves. That is, when the first guide member 1 is slid in the direction in which the width decreases (in the direction of the arrow A), the second guide member 2 moves in the direction (in the direction of arrow B) in which the distance to the first guide member 1 decreases. Further, when the first guide member 1 is slid in the direction in which the width increases (in the direction of the arrow B), the second guide member 2 moves in the direction (in the direction of arrow A) in which the distance to the first guide member 1 increases. In this manner, a user can place a document on the placing surface 15*a* of the document placing tray 15 and can bring the end portion 1*a* of the first guide member in the width direction and the end portion 2*a* of the second guide member in the width direction in contact with the end portions of the document in the width direction, respectively.

(Configuration for Setting a Small Size Document)

In the document conveying apparatus of the present embodiment, the first guide member 1 and the second guide member 2 are movable such that when a small size document such as a business card is set on the document placing tray 15, the leading end of the document accurately brings in contact with the shutters 3. Hereinafter, such configuration will be described with reference to FIGS. 7 to 11.

Figure 7:
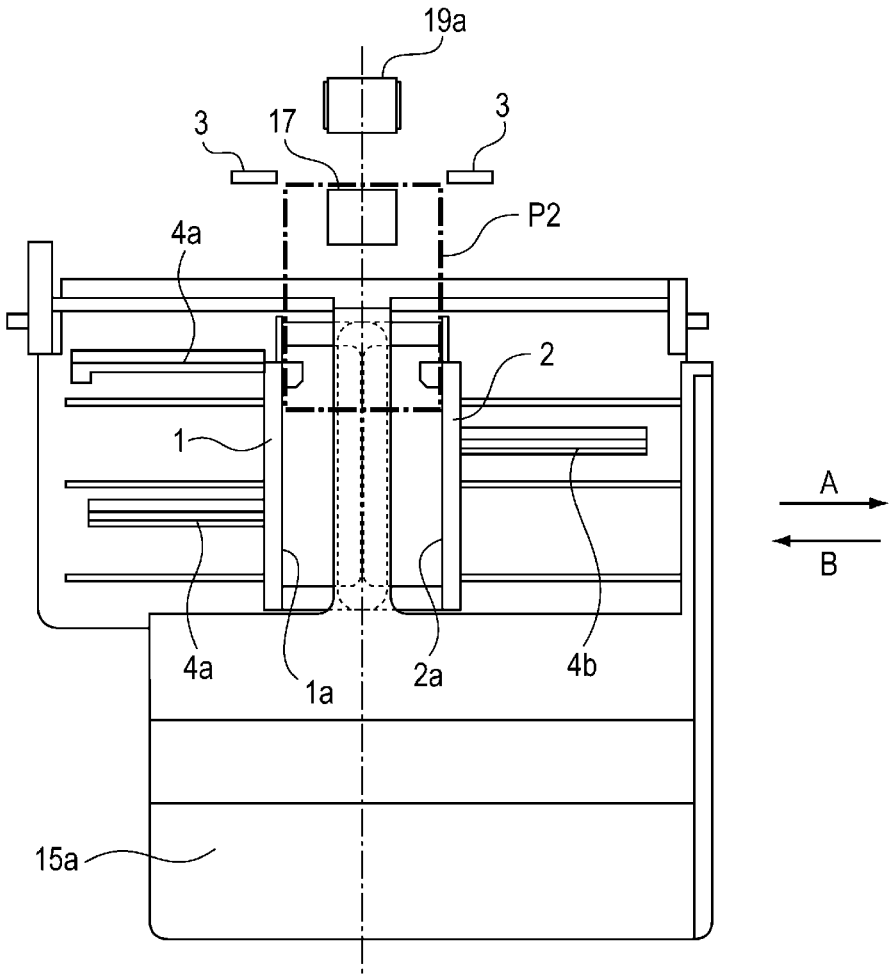
FIG. 7 is an explanatory plan view in a case where a document is not offset from the center of a feeding roller when a small size sheet is placed on the document placing tray.

Here, the case will be described where a small size document such as a business card is placed on the document placing tray 15 in the same manner as a normal size document such as A4 size and A3 size is placed. FIG. 7 shows a position at which the small size document P2 such as a business card is brought into contact with the shutters 3 of the feeding portion.

As shown in FIG. 7, when the first guide member 1 and the second guide member 2 are slid symmetrically with respect to the roller center 12 of the feeding roller 17 with the small size document P2 placed on the document placing tray 15, the small size document P2 cannot abut against the shutters 3 since the width of the small size document P2 is less than the interval of the shutters 3 of the feeding portion. Therefore, in the case of such a small size document P2, it is necessary to set the document P2 such that the small size document P2 is offset from the feeding roller center 12 in order that the document P2 is brought into contact with the shutters 3. In order to realize this, the present embodiment is configured as follows.

As described above, the first guide member 1 and the second guide member 2 are respectively provided with the slides 9 and 10 on which the rack portions 7 and 8 are respectively formed.

Figure 8:
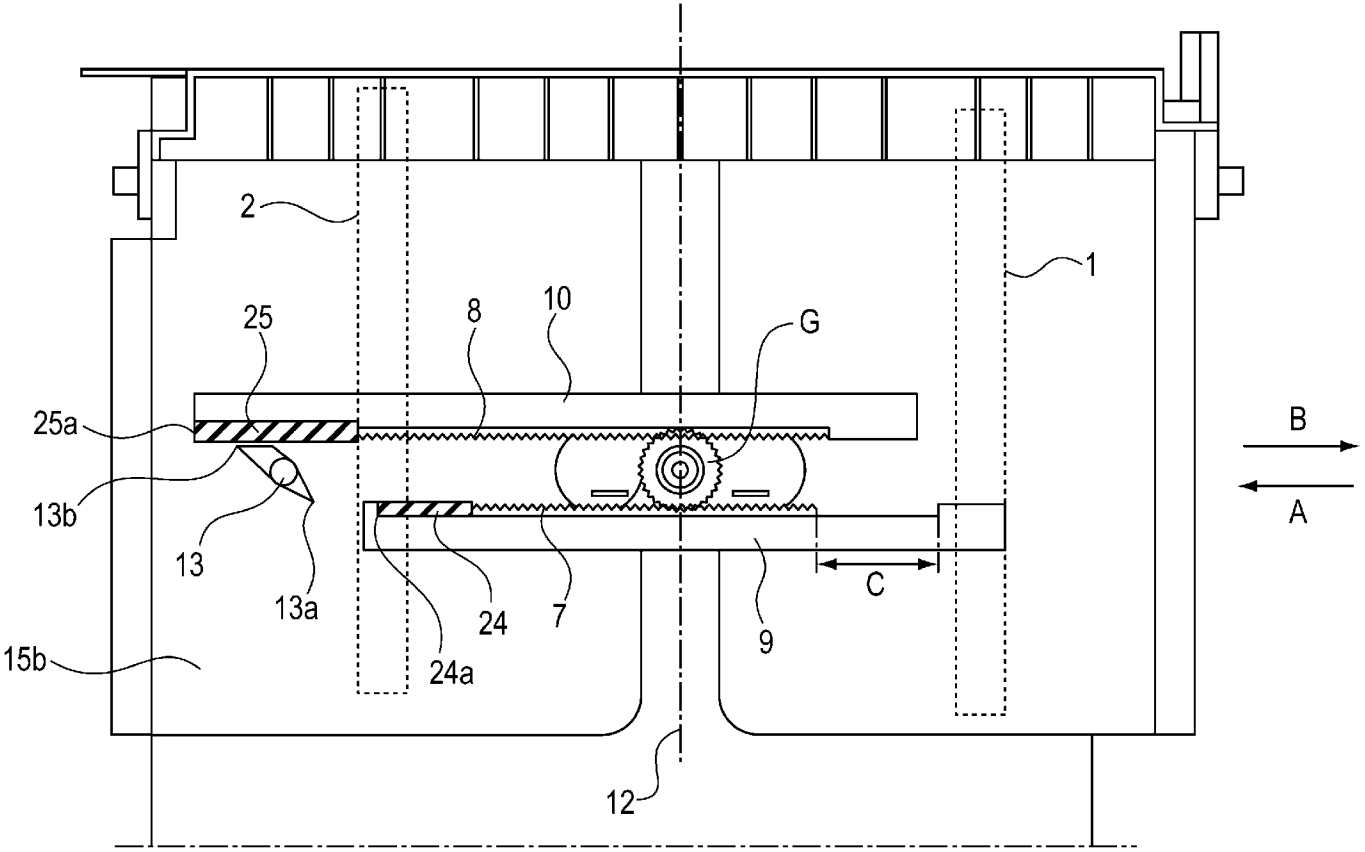
FIG. 8 is a rear view of the document placing tray of the first embodiment in a case where a first guide member is moved.
Figure 9:
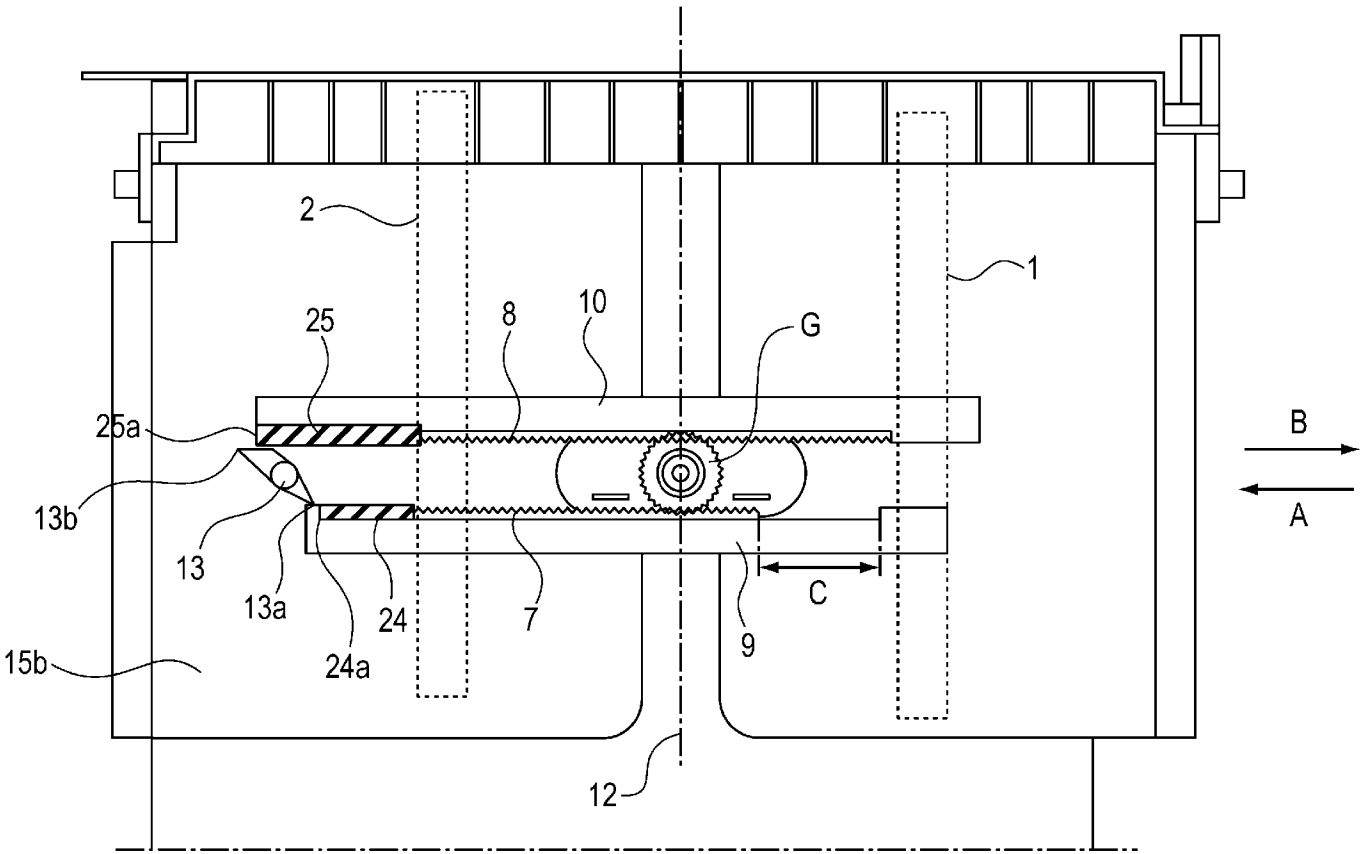
FIG. 9 is a rear view of the document placing tray of the first embodiment in a case where a first guide member is moved.

Further, as shown in FIGS. 8 and 9, the rotating link 13 working as a restricting portion is disposed at a position between the rack portions 7 and 8 of the slides 9 and 10. The rotating link 13 restricts the movement of the second guide member 2 when the first guide member 1 moves in a predetermined area. The rotating link 13 is configured to be rotatable around a column shaped shaft which protrudes by extending the document placing tray 15.

Here, in the present embodiment, the region C (second region) where a rack portion is not formed is provided at one end of the slide 9 which is formed integrally with the first guide member 1. That is, the slide 9 does not mesh with the pinion gear G when the second region C is opposed to the pinion gear G so that the first guide member 1 does not mesh with the second guide member 2. Namely, in this case, when the first guide member 1 is slid, only the first guide member 1 is slid without interlocking with the second guide member 2.

Therefore, when setting the small size document P2, the first guide member 1 is slid in the direction of arrow A, namely the direction in which the width decreases. As a result, in the first region in which the rack portion 7 of the first guide member 1 meshes with the pinion gear G, the first guide member 1 is interlocked with the second guide member 2 so that the first guide member 1 and the second guide member 2 move for the same distance in the directions of the arrows A and B, respectively. That is, when the first guide member 1 is moved in the direction of the arrow A from the position shown in FIG. 8 to the position shown in FIG. 10, the first guide member 1 moves until the position where the second region C is opposed to the pinion gear G as shown in FIG. 10.

When the first guide member 1 is located at the position where the second region C is opposed to the pinion gear G, the engagement between the pinion gear G and the rack portion 7 is released so that the first guide member on which the rack portion 7 is integrally formed is free from the movement of the second guide member on which the rack portion 8 is integrally formed. At the same time, the end portion 24*a* of the rib portion 24 formed on the slide 9 of the first guide member 1 starts to be in contact with the end portion 13*a* (one end portion) of the rotating link 13 as shown in FIG. 10.

Figure 10:
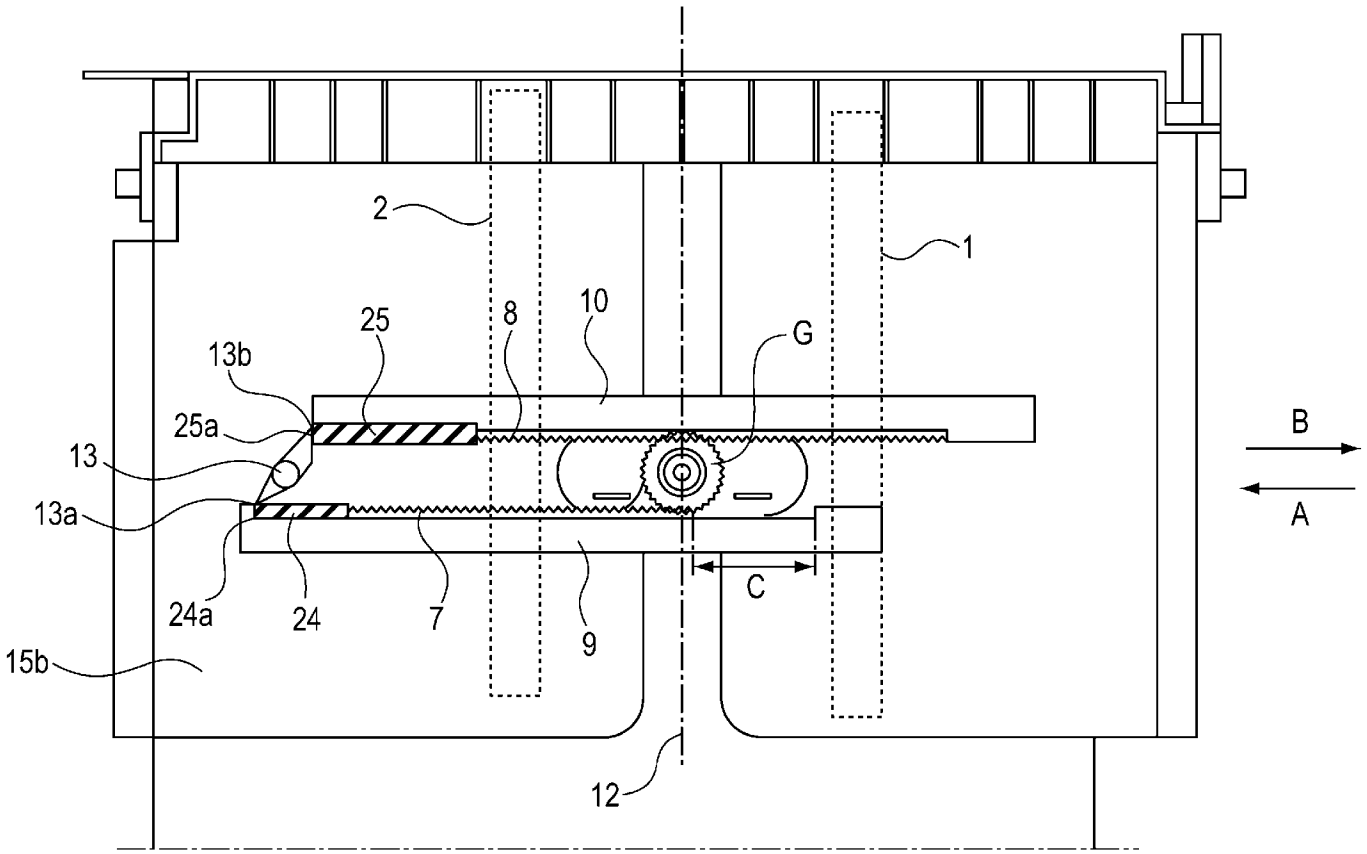
FIG. 10 is a rear view of the document placing tray of the first embodiment in a case where a first guide member is moved.

When the first guide member 1 is further moved in the direction of the arrow A, the end portion 24*a* of the rib portion 24 presses the rotating link 13 so that the rotating link 13 rotates in the clockwise direction in FIG. 10.

Figure 11:
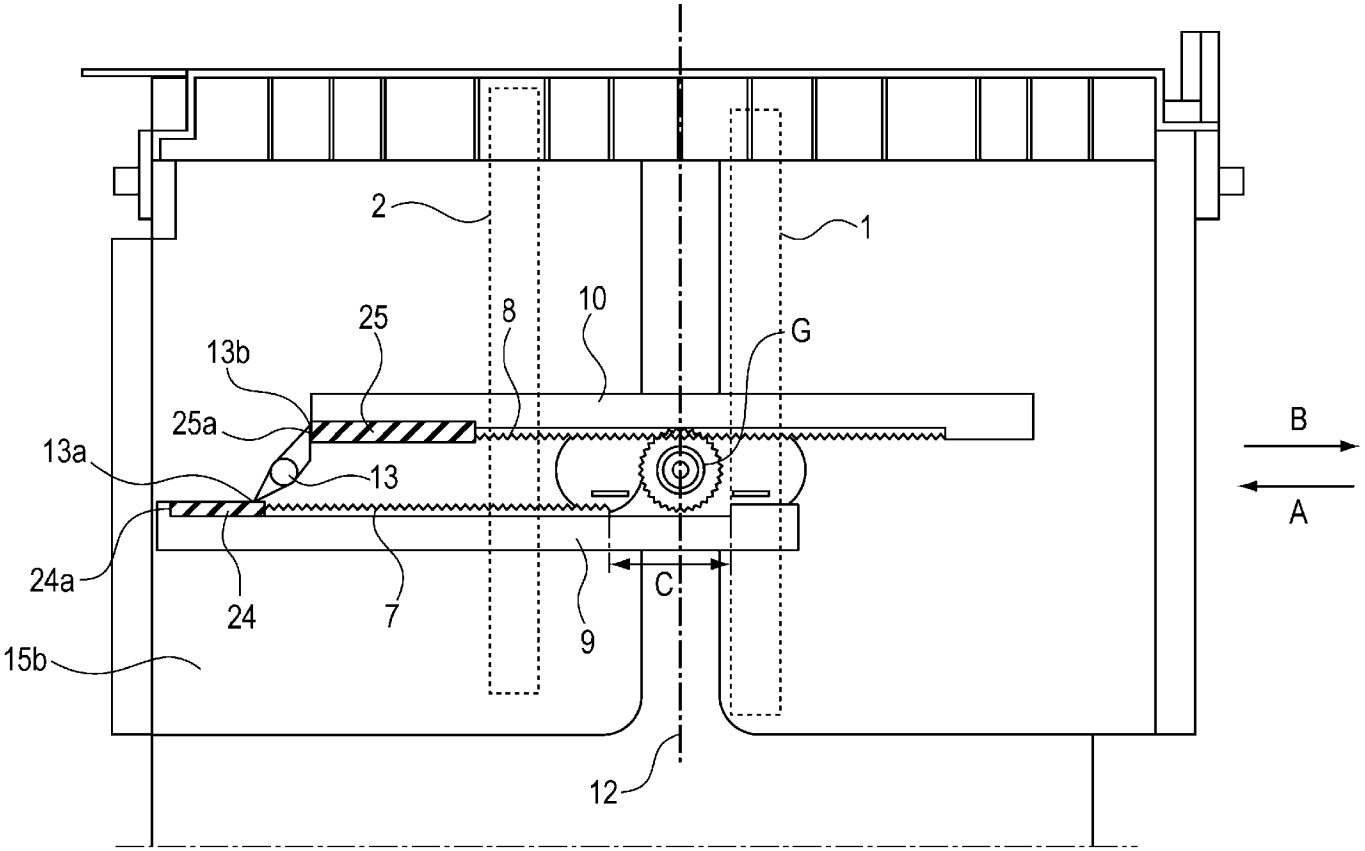
FIG. 11 is a rear view of the document placing tray of the first embodiment in a case where a first guide member is moved.

As a result, as shown in FIG. 11, the end portion 13*b* (the other end portion) of the rotating link 13 becomes into contact with the end portion 25*a* of the rib portion 25 of the second guide member 2. When the pinion gear G is opposed to the region C where a rack portion is not formed on the slide 9 of the first guide member 1, the rotation of the rotating link 13 is restricted by the end portion 13*a* being in contact with the rib portion 24 of the first guide member 1 so that the position of the end portion 13*b* is maintained (FIGS. 10 and 11).

Consequently, the end portion 13*b* of the rotating link 13 continues to be in contact with the end portion 25*a* of the rib portion 25 of the second guide member 2, during which the second guide member 2 cannot be moved in the direction of the arrow A. Therefore, the first guide member 1 can be moved in the direction A, but the second guide member 2 cannot be moved either in the direction A or in the direction B.

Figure 12:
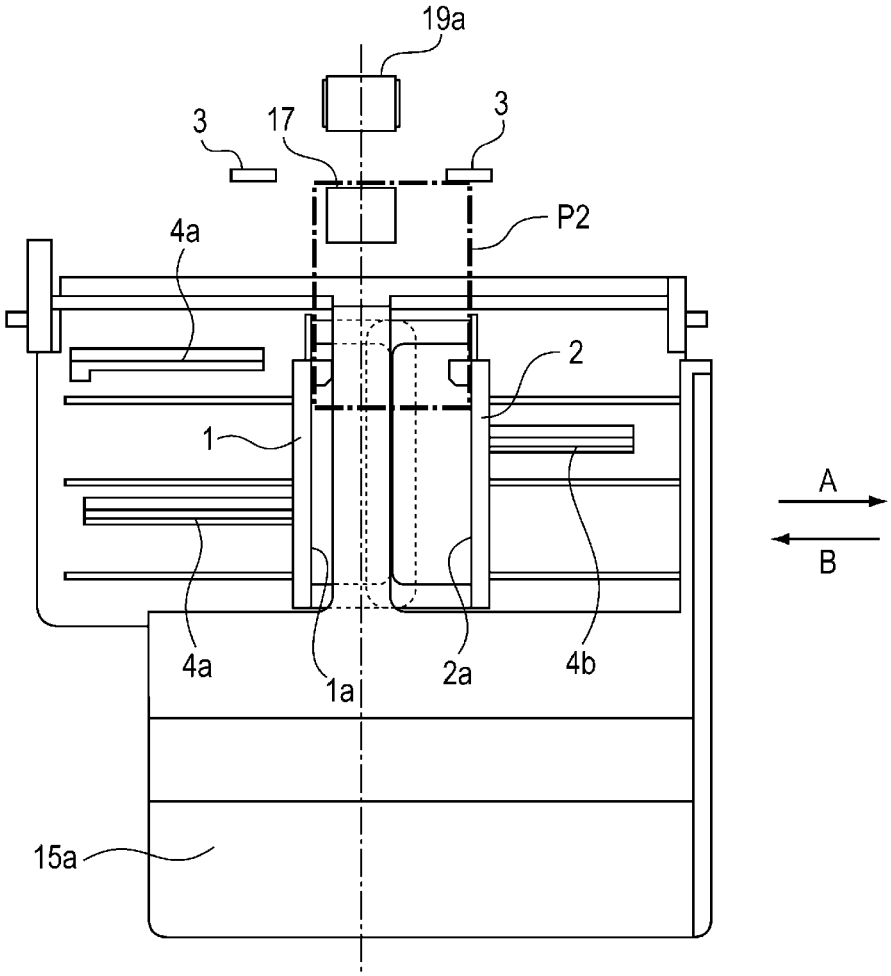
FIG. 12 is an explanatory plan view in a case where a document is offset from the center of a feeding roller when a small size sheet is placed on the document placing tray.

When the pinion gear G is opposed to the region C where a rack portion is not formed on the slide 9 of the first guide member 1, the first guide member 1 can be freely slid in the direction in which the width decreases independently from the second guide member 2. As a result, as shown in FIG. 12, when the small size document P2 is placed, even if the first guide member 1 is offset inwardly with respect to the center 12 of the feeding roller, the first guide member 1 and the second guide member 2 can be in contact with the end portions of the small size document P in the width direction, respectively and this state can be maintained. Further, the apparatus can be configured such that the small size document P2 such as a business card can be offset such that the leading end of the small size document P2 is brought in contact with the shutters 3 of the feeding portion.

On the other hand, when the first guide member 1 is slid in the direction of the arrow B from the state shown in FIG. 11, operations reverse to the above explanation are performed. That is, when the first guide member 1 is returned to the position shown in FIG. 10 in the direction B, the rack portion 7 of the slide 9 which has not been meshed with the pinion gear G starts to mesh with the pinion gear G again. At the same time, the engagement of end portion 24*a* of the rib portion 24 of the slide 9 with the end portion 13*a* of the rotating link 13, which has restricted the rotation of the rotating link 13, is released so that the rotating link 13 can be rotated counterclockwise.

Then, as shown in FIGS. 9 to 8, the rotation of the rotating link 13 is urged by the end portion 25*a* of the rib portion 25 of the second guide member 2 so that the rotating link 13 is returned to the original position.

As described above, according to the configuration of the present embodiment, at the same time as the pinion gear G and the rack portion 7 of the slide 9 begin to mesh with each other, the restriction of the rotation of the rotating link 13 is released. As a result, the positional relationship between the slide 9 and the slide 10 is always kept correct. Further, whether the document is a normal size sheet or a small size sheet, the document can be properly set by using the first guide member 1 and the second guide member 2 without using a special holder or the like.

Second Embodiment

In the above-described embodiment, the pinion gear G and the rotating link 13 are attached to the document placing tray 15, but as shown in the second embodiment, the pinion gear G and the rotating link 13 can be provided on the document placing tray 15 such that the pinion gear G and the rotating link 13 are movable with respect to the document placing tray 15.

Figure 13:
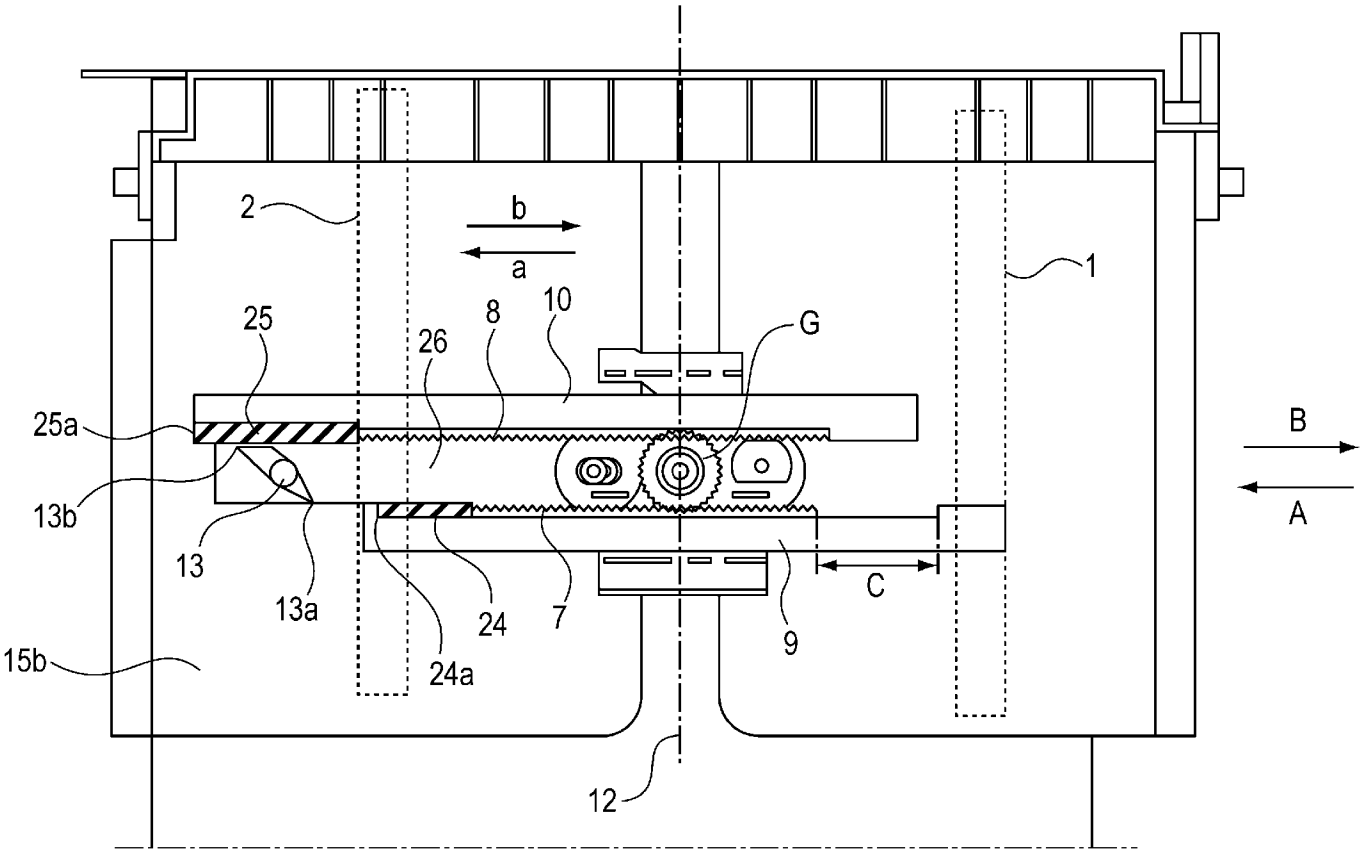
FIG. 13 is a rear view of the document placing tray of the second embodiment.

FIG. 13 shows the rear side of the document placing tray 15 according to the second embodiment. In the present embodiment, the pinion base 26 serving as a moving portion is provided so as to be movable in the document width directions (directions of arrows a and b in FIG. 13) with respect to the document placing tray 15. The pinion gear G and the rotating link 13 are attached respectively to the shafts provided on the pinion base 26 so that the pinion gear G and the rotating link 13 are rotatable around the shafts respectively. On the other hand, the first guide member 1, the second guide member 2, the rack portion 7 and the rack portion 8 are slidable in the document width direction with respect to the document placing tray 15 similarly as in the first embodiment.

According to the above configuration, the pinion base 26 can be moved in the document width directions with respect to the document placing tray 15 integrally with the first guide member 1 and the second guide member 2. Thus, it is possible to integrally adjust the first guide member 1 and the second guide member 2 with respect to the displacement in the width directions of the document.

In the first embodiment and the second embodiment described above, the second region C in which a rack part is not formed is provided at one end of the slide 9 of the first guide member 1. However, it is obvious that the same effect can be obtained by providing the second region where a rack portion is not provided on the slide 10 of the second guide member 2 instead of the first guide member 1.

In the first embodiment and the second embodiment described above, the sheet conveying apparatus having the moving configuration of the first guide member 1 and the second guide member 2 is applied to the document reading apparatus. However, such moving configuration may be applied to the image forming portion 300. For example, by applying such moving configuration to a manual feeding tray or the like for feeding a recording sheet to the image forming portion 300, it is possible to form an image by feeding a small size sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-088545, filed May 2, 2018, which is hereby incorporated by reference herein in its entirety.

What is claimed is:

1. A sheet conveying apparatus comprising:

a placing portion on which a sheet is placed;

a conveying member configured to convey the sheet placed on the placing portion;

a first guide member configured to restrict a movement of an end portion of the sheet placed on the placing portion in a sheet width direction which is orthogonal to a conveying direction of the sheet;

a second guide member configured to restrict a movement of the other end portion of the sheet placed on the placing portion in the sheet width direction; and a moving portion, wherein when one guide member of the first guide member and the second guide member is moved in the sheet width direction, the moving portion moves the other guide member of the first guide member and the second guide member in a direction opposite to a direction in which the one guide member is moved while being interlocked with a movement of the one guide member in a first area of a moving area, and the moving portion allows the one guide member to be moved without being interlocked with a movement of the other guide member in a second area of the moving area, wherein the moving portion comprises a restricting portion configured to restrict a movement of the other guide member when the one guide member moves in the second area, wherein the moving portion further comprises (a) a first rack portion provided on the first guide member, (b) a second rack portion provided on the second guide member, and (c) a pinion gear with which the first rack portion and the second rack portion mesh, and wherein a mesh of one of the first rack portion and the second rack portion with the pinion gear is released in the second area.

2. The sheet conveying apparatus according to claim 1, wherein the restricting portion is rotated by being pressed by the one guide member which is moving in the second area so that the restricting portion engages with the other guide member.

3. The sheet conveying apparatus according to claim 1, wherein the pinion gear and the restricting portion are provided on the moving portion which is movable in the sheet width direction.

4. The sheet conveying apparatus according to claim 1, wherein an interval between the first guide member and the second guide member in a case where the one guide member is located in the second area is narrower than an interval between the first guide member and the second guide member in a case where the one guide member is located in the first area.

5. An image reading apparatus comprising:

a reading portion configured to read an image formed on a sheet;

a placing portion on which a sheet is placed;

a conveying member configured to convey the sheet placed on the placing portion;

a first guide member configured to restrict a movement of an end portion of the sheet placed on the placing portion in a sheet width direction which is orthogonal to a conveying direction of the sheet;

a second guide member configured to restrict a movement of the other end portion of the sheet placed on the placing portion in the sheet width direction; and a moving portion, wherein when one guide member of the first guide member and the second guide member is moved in the sheet width direction, the moving portion moves the other guide member of the first guide member and the second guide member in a direction opposite to a direction in which the one guide member is moved while being interlocked with a movement of the one guide member in a first area of a moving area, and the moving portion allows the one guide member to be moved without being interlocked with a movement of the other guide member in a second area of the moving area, wherein the moving portion comprises a restricting portion configured to restrict a movement of the other guide member when the one guide member moves in the second area, wherein the moving portion further comprises (a) a first rack portion provided on the first guide member, (b) a second rack portion provided on the second guide member, and (c) a pinion gear with which the first rack portion and the second rack portion mesh, and wherein a mesh of one of the first rack portion and the second rack portion with the pinion gear is released in the second area.

6. The image reading apparatus according to claim 5, wherein the restricting portion is rotated by being pressed by the one guide member which is moving in the second area so that the restricting portion engages with the other guide member.

7. The image reading apparatus according to claim 5, wherein the pinion gear and the restricting portion are provided on the moving portion which is movable in the sheet width direction.

8. The image reading apparatus according to claim 5, wherein an interval between the first guide member and the second guide member in a case where the one guide member is located in the second area is narrower than an interval between the first guide member and the second guide member in a case where the one guide member is located in the first area.

9. An image forming apparatus comprising:

an image forming portion configured to form an image on a sheet;

a placing portion on which a sheet is placed;

a conveying member configured to convey the sheet placed on the placing portion;

a first guide member configured to restrict a movement of an end portion of the sheet placed on the placing portion in a sheet width direction which is orthogonal to a conveying direction of the sheet;

a second guide member configured to restrict a movement of the other end portion of the sheet placed on the placing portion in the sheet width direction; and a moving portion, wherein when one guide member of the first guide member and the second guide member is moved in the sheet width direction, the moving portion moves the other guide member of the first guide member and the second guide member in a direction opposite to a direction in which the one guide member is moved while being interlocked with a movement of the one guide member in a first area of a moving area, and the moving portion allows the one guide member to be moved without being interlocked with a movement of the other guide member in a second area of the moving area, wherein the moving portion comprises a restricting portion configured to restrict a movement of the other guide member when the one guide member moves in the second area, wherein the moving portion further comprises (a) a first rack portion provided on the first guide member, (b) a second rack portion provided on the second guide member, and (c) a pinion gear with which the first rack portion and the second rack portion mesh, and wherein a mesh of one of the first rack portion and the second rack portion with the pinion gear is released in the second area.

10. The image forming apparatus according to claim 9, wherein the restricting portion is rotated by being pressed by the one guide member which is moving in the second area so that the restricting portion engages with the other guide member.

11. The image forming apparatus according to claim 9, wherein the pinion gear and the restricting portion are provided on the moving portion which is movable in the sheet width direction.

12. The image forming apparatus according to claim 9, wherein an interval between the first guide member and the second guide member in a case where the one guide member is located in the second area is narrower than an interval between the first guide member and the second guide member in a case where the one guide member is located in the first area.

* * * * *